US010926148B2

(12) United States Patent
Manley

(10) Patent No.: US 10,926,148 B2
(45) Date of Patent: Feb. 23, 2021

(54) SNOWBOARD TRAINING SUPPORT APPARATUS

(71) Applicant: David Chalfant Manley, Budd Lake, NJ (US)

(72) Inventor: David Chalfant Manley, Budd Lake, NJ (US)

( * ) Notice: Subject to any disclaimer, the term of this patent is extended or adjusted under 35 U.S.C. 154(b) by 0 days.

(21) Appl. No.: 15/914,869

(22) Filed: Mar. 7, 2018

(65) Prior Publication Data

US 2018/0256956 A1 Sep. 13, 2018

Related U.S. Application Data

(60) Provisional application No. 62/468,902, filed on Mar. 8, 2017.

(51) Int. Cl.

| | |
|---|---|
| ***A63C 11/00*** | (2006.01) |
| ***A63B 69/18*** | (2006.01) |
| ***A63C 5/06*** | (2006.01) |
| ***A63C 5/048*** | (2006.01) |
| ***A63C 5/03*** | (2006.01) |
| ***A63C 10/28*** | (2012.01) |
| *A63B 69/00* | (2006.01) |
| *A63B 71/02* | (2006.01) |

(52) U.S. Cl.

CPC ..... *A63B 69/18* (2013.01); *A63C 5/03* (2013.01); *A63C 5/0485* (2013.01); *A63C 5/06* (2013.01); *A63C 10/28* (2013.01); *A63C 11/00* (2013.01); *A63B 69/0064* (2013.01); *A63B 69/0093* (2013.01); *A63B 71/023* (2013.01); *A63B 2225/09* (2013.01)

(58) Field of Classification Search

CPC ... A63B 69/18; A63B 69/0064; A63B 69/182; A63B 69/0066; A63B 2244/19; A63C 5/00; A63C 5/03; A63C 5/06; A63C 5/16; A63C 11/00; A63C 10/28; A63C 2201/10; A63C 2201/02

See application file for complete search history.

(56) References Cited

U.S. PATENT DOCUMENTS

| | | | | | |
|---|---|---|---|---|---|
| 3,542,389 | A * | 11/1970 | Stiller | B62B 13/16 | 280/16 |
| 4,911,461 | A * | 3/1990 | Humphrey | A63C 5/06 | 188/5 |
| 4,986,561 | A * | 1/1991 | Humphrey | A63C 11/00 | 280/605 |
| 5,312,258 | A * | 5/1994 | Giorgio | A63C 17/01 | 280/14.24 |
| 5,370,415 | A * | 12/1994 | Humphrey | A63C 5/06 | 188/5 |
| 6,007,101 | A * | 12/1999 | Pritchard | A63C 5/03 | 280/14.22 |
| 6,264,215 | B1 * | 7/2001 | Carlson | A63C 5/03 | 280/14.21 |
| 6,308,978 | B1 * | 10/2001 | Kelman | A63C 5/16 | 280/14.21 |

(Continued)

*Primary Examiner* — James M Dolak

(57) ABSTRACT

A snowboard support apparatus, attached to the snowboard in such a way that it extends from the board and provides a physical support for the rider to lean against in order to aid in the process of learning to snowboard. The support apparatus provides support to the rider to allow them to develop skills in being able to ride a snowboard in an incremental and natural manner without constraining the riding experience.

4 Claims, 4 Drawing Sheets

(56) References Cited

U.S. PATENT DOCUMENTS 6,592,150 B2 * 7/2003 Kernan ..... A63C 5/00 280/809
6,626,443 B2 * 9/2003 Lafond ..... A63C 5/03 280/14.22
6,634,657 B2 * 10/2003 Graham ..... A63C 5/16 280/14.27
6,695,323 B2 * 2/2004 Backlund ..... A63C 7/1066 188/6
6,767,313 B2 * 7/2004 Sayce ..... A63B 69/18 482/146
7,137,925 B2 * 11/2006 Rozycki ..... A63B 69/0093 482/51
7,281,729 B1 * 10/2007 Wilson ..... A63C 5/0485 280/602
8,096,563 B2 * 1/2012 Buchwald ..... B62B 17/066 280/28.15
8,157,285 B2 * 4/2012 Wasserman ..... A63C 7/1066 280/14.22
8,286,989 B2 * 10/2012 Wasserman ..... A63C 7/108 280/14.22
8,529,268 B2 * 9/2013 Coleman ..... A63B 69/18 434/253
9,232,829 B2 * 1/2016 Breach ..... A43B 5/0417
9,545,561 B2 * 1/2017 Edmonston ..... A63C 10/28
10,238,942 B2 * 3/2019 Dalton ..... A63B 69/0093
10,315,097 B2 * 6/2019 Wood, V ..... A63C 5/03
10,549,175 B2 * 2/2020 Arcouette ..... B62B 17/065
10,625,139 B2 * 4/2020 Tickner ..... A63C 5/062
10,695,653 B2 * 6/2020 Flowers ..... A63C 5/06
10,754,682 B2 * 8/2020 Bradford, III ..... G06F 12/084
2006/0071449 A1 * 4/2006 Backlund ..... A63C 7/1066 280/605
2007/0075524 A1 * 4/2007 Kelly ..... A63C 10/28 280/605
2007/0254781 A1 * 11/2007 MacCarron ..... A63B 69/0093 482/51
2016/0089591 A1 * 3/2016 Williamson ..... A63B 69/0093 434/253

* cited by examiner

SNOWBOARD TRAINING SUPPORT APPARATUS

RELATED APPLICATIONS

This application claims priority of U.S. Provisional Application 62/468,902, which was filed on Mar. 8, 2017, and hereby incorporates the subject matter of the provisional application in its entirety.

FIELD OF INVENTION

The invention generally relates to a snowboard training support apparatus.

BACKGROUND

The sport of snowboarding is one of the most popular winter sports. Many enjoy the winter activity, however, there is a large learning curve to the sport. If you go to a ski resort, it is very common to see beginner snowboarders sitting all over the ski slope, or repeatedly standing and falling over and over. This propensity to fall is common in beginners as they attempt to learn how to lean the board far enough to be able to engage the board's edges and carve into the snow while maintaining balance. Since it is very common to fall when learning proper technique, beginners often attempt to avoid learning these techniques. As a result, it is also common to see beginners going straight down the mountain without carving. However, trying to remain on the flat portion of your board usually results in picking up speed rapidly and then catching an edge of the board, which only leads to larger falls and an even slower learning progression. As a result, many beginners have a disappointing first day snowboarding, and many even quit after this experience. Traditionally, the only option available to beginner snowboarders is to take numerous lessons, which can be very expensive.

The overall customer needs for the beginner snowboarder are to learn to snowboard incrementally, safely, and inexpensively. Specifically, in order to learn incrementally, the beginner needs to be able to learn in stages of progressing difficulty. In order to learn safely, the beginner needs to fall less often. The present invention seeks to solve these issues.

Unfortunately, due to habitualization, this problem has largely been ignored. There have been a few inventions such as U.S. patent application Ser. No. 09/917,387 and U.S. patent application Ser. No. 09/251,389, which were created in order to attempt to mitigate similar issues. However, both of these inventions create constraints unnatural to snowboarding and do not prevent the rider from falling when they lean too far uphill. In addition, patents WO1991011230 and KR101632608B1 describe devices that are specific to skiing and would not be applicable to a snowboard since they would affect the ability of the rider to carve and lean the board. The snowboarding platform is unique in that the rider needs to lean uphill and dig the board's edge into the snow in order to turn.

BRIEF SUMMARY OF INVENTION

The present invention seeks to improve upon and introduce an innovative approach to solving the issues of teaching beginners how to snowboard. Through observations, it was noticed that several people attempted to help beginners learn to snowboard by providing them physical support as they learned how to balance. Unfortunately, since the person providing support is typically on either a snowboard or skis, these attempts were largely unsuccessful.

The current invention is designed to provide a physical support to beginner snowboarders in order to aid in the development of proper technique and incremental learning The support apparatus attaches to the snowboard in order to aid the rider without any needed input from the rider, so that the rider can focus on learning, and can learn with the least unconventional constraints possible. In addition, the support apparatus device is attached to the board without the need of any modification to the rider's equipment. The support apparatus features sliding members that extend from the base of the support apparatus, which is attached to the snowboard. The sliding member is set at an angle to allow the board to lean before the sliding member comes in contact with the snow. This allows the user to lean to a certain degree before the sliding member contacts the snow and provides a force to help the rider balance.

This angle can be adjusted in order to allow the rider to lean the board farther before receiving support from the support apparatus. In this way the rider can incrementally increase the angle, allowing him or her to become more accustomed with leaning the board and carving, while still having an added support if he or she loses his or her balance.

Once the rider is comfortable with leaning the board, balancing, and carving, and no longer feels the need for the added support and the support apparatus, the support apparatus can be easily detached and the snowboard will return to its original configuration. These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive.

DETAILED DESCRIPTION OF THE INVENTION

It is an object of the invention to create an apparatus, which attaches to the board 1 so as to be able to provide support to the rider 9 without any other input. For example, no other human is needed to operate the device for the user, and the user does not need to do anything while riding to utilize the device. In this way the user is able to focus solely on the task of learning, and the device will act on its own.

It is a further object of the invention that the device creates a physical support, which can be incrementally adjusted to allow the board 1 and rider 9 to lean to an increased angle before the sliding member 4 comes in contact with the ground 10. When the sliding member 4 comes in contact with the ground 10, the device provides support to the rider 9. This is due to the fact that the sliding member 4 creates a force, which acts to resist further motion of the board 1 in an angular direction, thereby keeping the board 1 from leaning any further. This force acts against the rider 9 and provides them an added support and level of stability.

Figure 1:
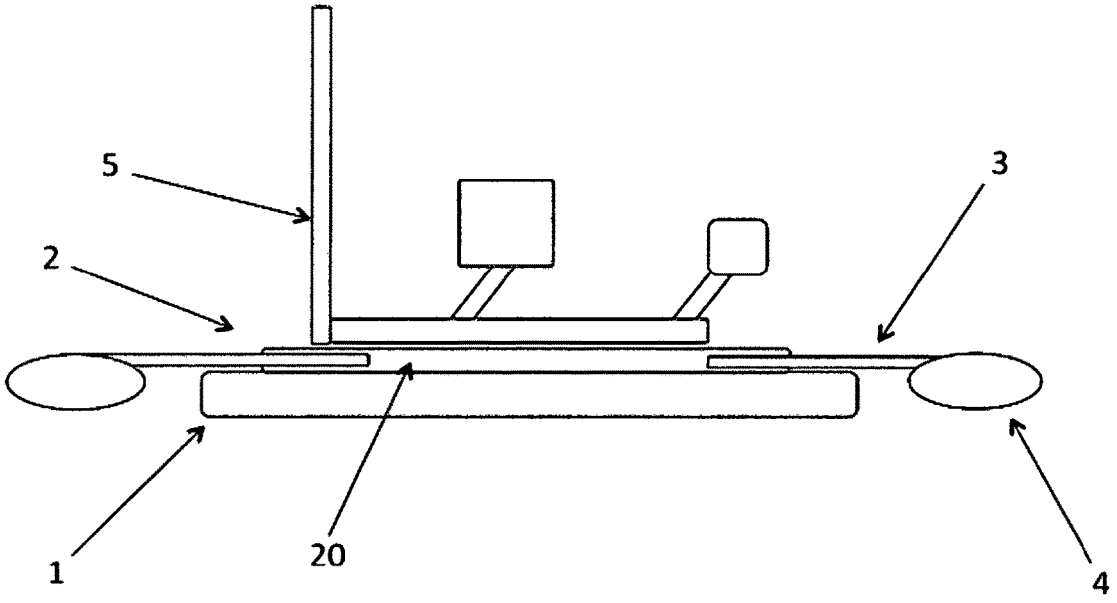
FIG. 1 is a side view, showing the apparatus attached to the snowboard 1, under a respective binding 5, with the sliding members 4 extending from the board.
Figure 8:
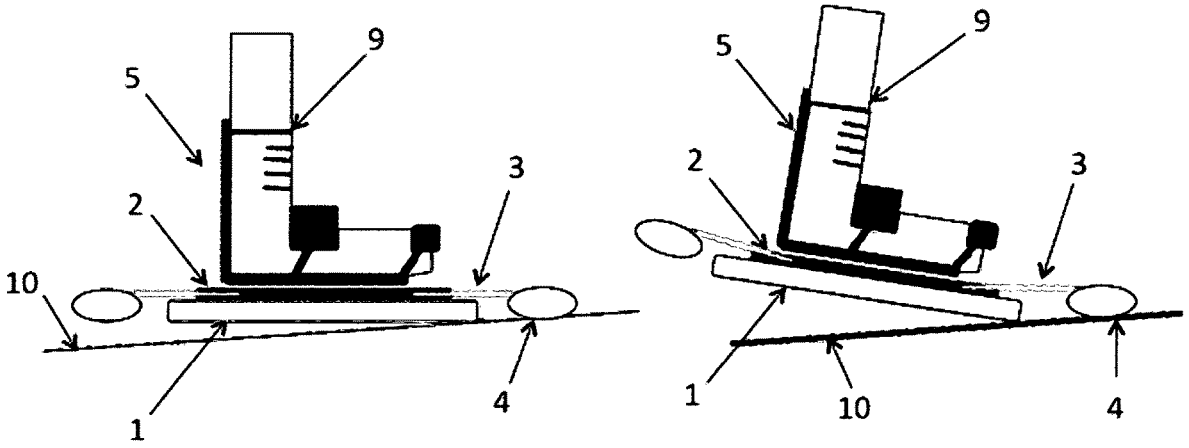
FIG. 8 is a side view showing the comparison of setting the angle of the support apparatus 2 at two different angles in order to show how increasing in the angle relative to the snowboard 1 allows the rider 9 to lean farther uphill before the sliding member contacts the ground 10 and provides support to the rider 9.

As can be seen in FIG. 1, the base 20 of the support apparatus 2 is attached to the snowboard 1 and is secured in between a respective binding 5 and the snowboard 1. The support apparatus 2 features arms 3 with a base end 12 attached to the base 20 of the support apparatus 2 and which extend from the base 20 of the support apparatus 2 and which feature a sliding member 4 at the outrigger end 11 of the arms 3. This sliding member 4 comes in contact with the snow in order to provide a supportive force to the rider 9, as can be seen in FIG. 8.

Figure 2:
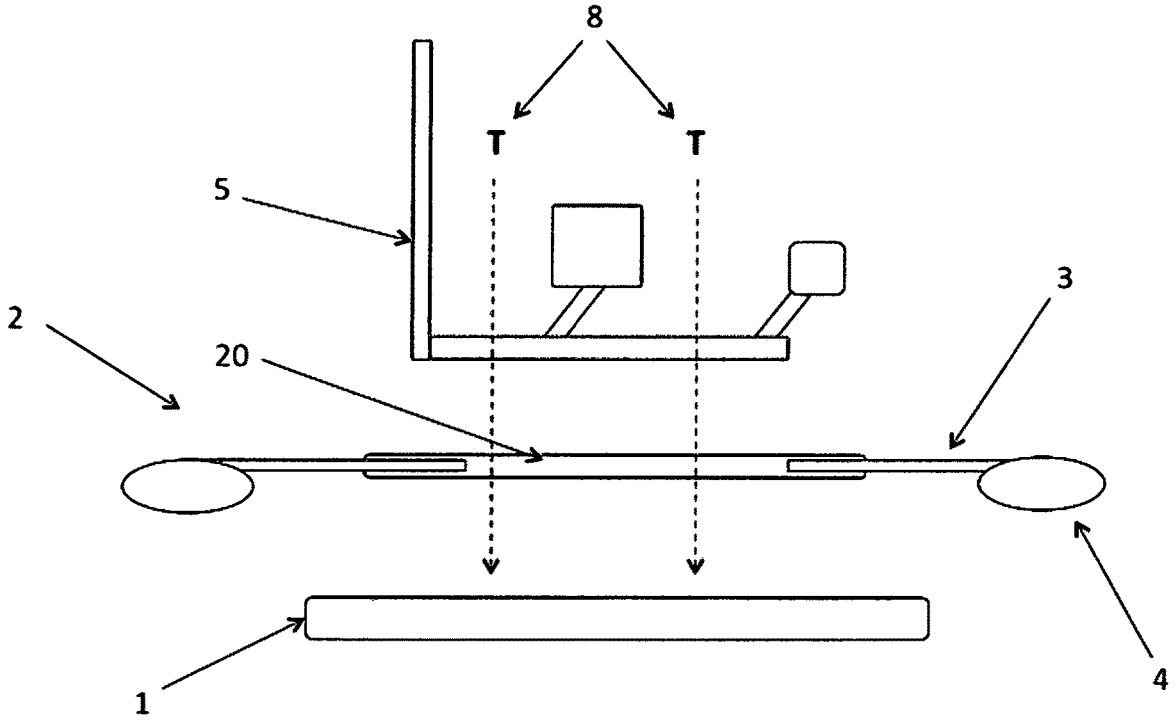
FIG. 2 is an exploded view showing how the support apparatus 2 is attached to the snowboard 1.
Figure 3:
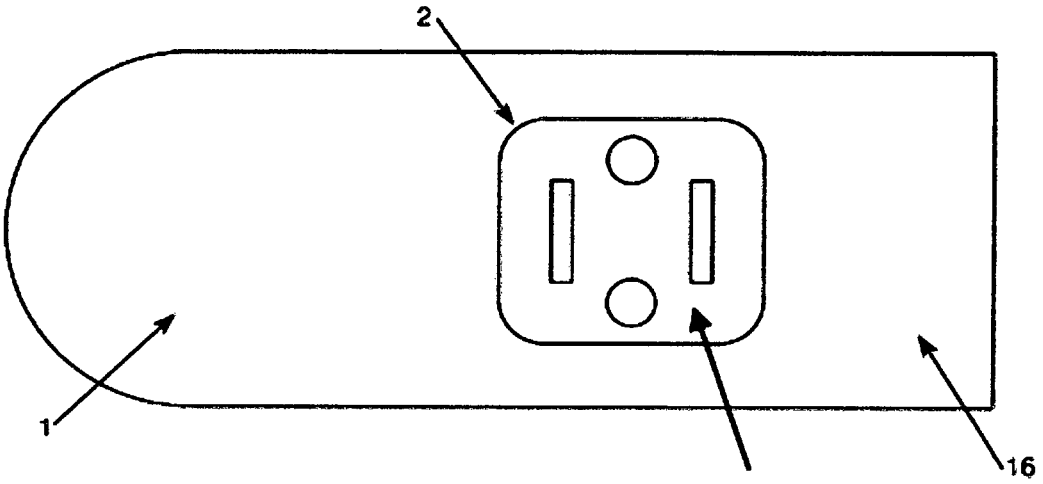
FIG. 3 is a detail view, looking down at the top of the board 1, showing only the base of the support apparatus 2 in order to show the geometry, which allows it to interface with the binding insert disc.

As can be seen in FIG. 2 the support apparatus 2 is secured in between the snowboard 1 and the respective binding 5, using fasteners 8 which extend through the binding insert disk, through the base 20 of the support apparatus 2 and are fastened to the snowboard 1. FIG. 2 shows a detailed look at the base 20 of the support attachment 2, which features geometry intended to allow the support apparatus to interface with the binding insert disk.

Figure 5:
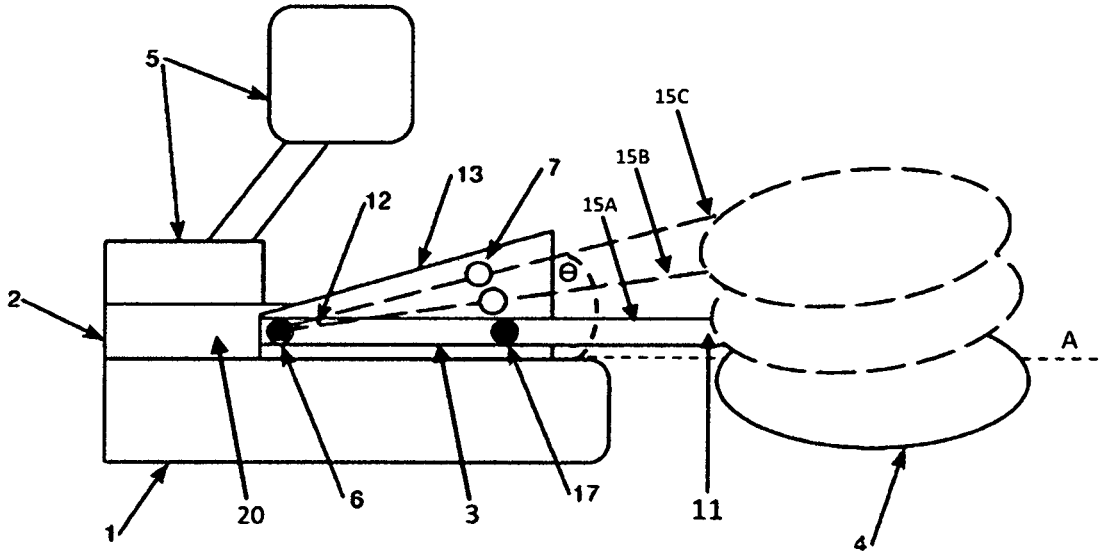
FIG. 5 is a side view of the invention, and detail image of FIG. 4, showing how the angle Θ of the arm 3 can be adjusted by rotating the sliding member 4 and arms 3 which each have a base end 12 and an outrigger end 11, about a fixed point 6, and locking the arm 3 in a fixed position by placing a pin or other device 17 at a point between the base end 12 and the outrigger end 11 of the arm 3 and in a corresponding hole 7 of the base 20 of the support apparatus 2.
Figure 6:
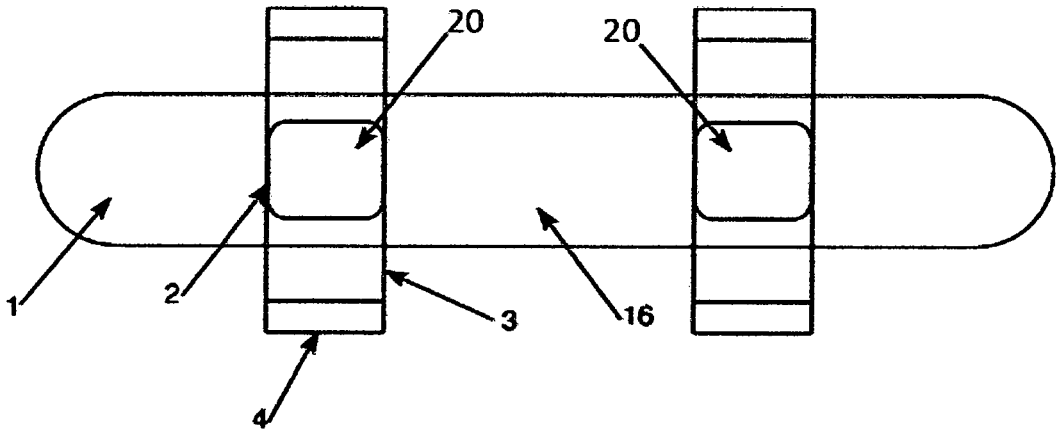
FIG. 6 is a top view showing a preferred embodiment of the present invention which features two support apparatuses 2, one located under a front binding (not shown), and one located under a back binding (not shown) which each support apparatus 2 have two sliding members 4, one sliding member 4 extending from each side of the board 1 by a pair of arms 3.
Figure 7:
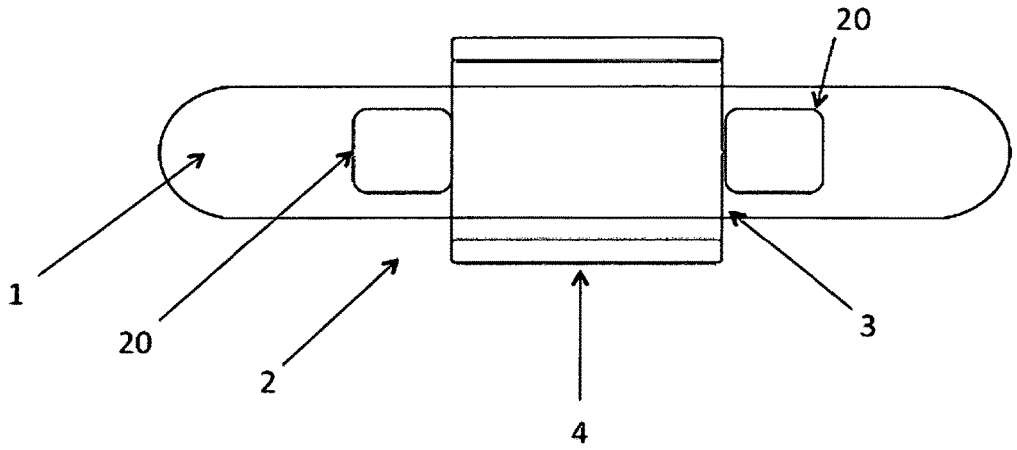
FIG. 7 is a top view showing a preferred embodiment of the present invention which features one support apparatus 2, with two bases 20, one located under a back binding (not shown) and a front binding (not shown), and featuring two sliding members 4, one extended from each side of the snowboard 1, in between the two bases 20.

In one embodiment of the invention, the rider 9 will first remove the bindings from their snowboard 1. They will then align the support apparatus 2 with the holes in the binding insert disc and use fasteners 8 to attach the support apparatus 2 to the board 1 under a respective binding 5. The support apparatus 2 features hole patterns to allow it to interface with all major binding insert disc patterns, allowing the support apparatus 2 to be used universally on all snowboards. The design can be adjusted in length to account for various snowboard widths, and also in width to adjust for various binding and snowboard widths. After this the rider 9 will select their corresponding skill level by moving the arm 3 and sliding member 4 to the desired angle Θ relative to the snowboard 1. This method of adjustment can be seen in FIG. 5, which shows several angular positions 15A-C of the arm 3 and sliding member 4 transposed on top of one another. As shown in FIG. 5, for example, the arm 3 and sliding member 4 can be disposed at a first angular position 15A, in which the outrigger end 11 of the arm 3 is separated from a plane A defined by the top surface 16 of the snowboard 1 by a first height. The arm 3 and sliding member 4 can be disposed at one or more second angular positions 15B, 15C, in which the outrigger end 11 of the arm 3 is separated from the plane A defined by the top surface 16 of the snowboard 1 by a second height greater than the first height. In this way the rider 9 will be able to select how far they will be able to lean before the support apparatus 2 provides support to them. At the beginner level, the snowboard is only able to lean slightly before the support apparatus 2 provides support. This support allows the beginner to lean into the hill 10 and to learn what it feels like to carve, with the added benefit of having additional support. After the rider 9 is comfortable with the beginner setting, they are then able to raise the sliding member 4 to the next level. This will allow the rider 9 to lean even further before they are provided support. As the angle Θ is continually increased, the rider 9 will be able to rely more and more on their own balance, while still having the support there in case of momentary instability to provide them with added support. After the rider 9 is comfortable at all levels of the support apparatus 2, the fasteners 8 can easily be removed and the board can be returned to its original configuration.

Figure 4:
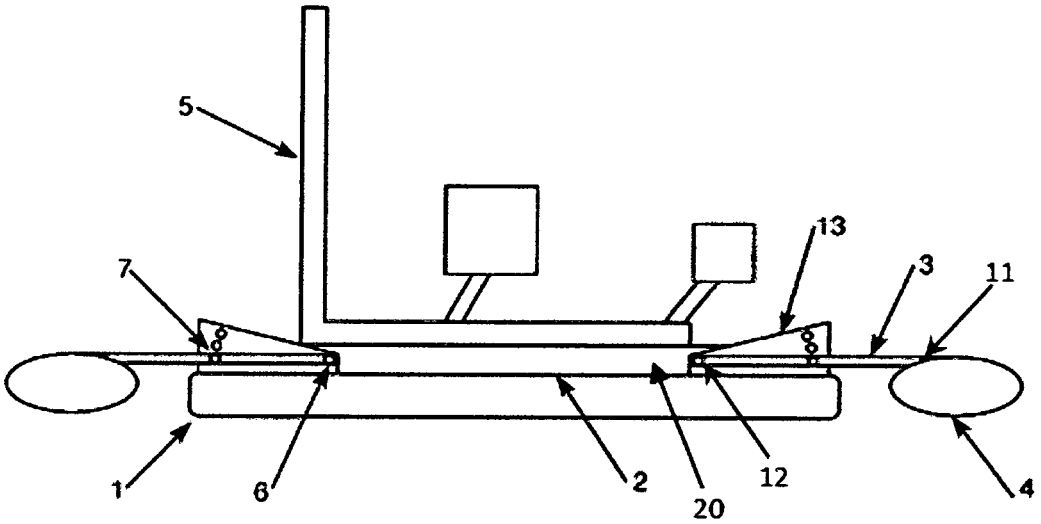
FIG. 4 is a side view of one of the preferred embodiments of the present invention, in which the base of the support apparatus 2 features a raceway 13 with holes 7 for the arms 3 to interface with, in order to lock the arm 3 at a given angle Θ with respect to the top surface 16 of the snowboard 1.

One embodiment of the design, which can be seen in FIG. 4, shows the sliding member 4 is located at the outrigger end 11 of two arms 3, one arm 3 on either end of the sliding member 4, which extend from the base 20 of the support apparatus 2. The arms 3 are pinned 6 to the base 20 of the support apparatus 20 at the base end 12 closest to the center of the snowboard 1. The base 20 of the support apparatus 2 features a raceway 13 with holes 7 which allow a cotter pin, shear pin, spring plunger, or other device 17 to be placed into the raceway hole 7, thereby locking the arm 3 at the desired angle Θ. This can be seen in detail in FIG. 5. To adjust the angle Θ of the arm 3 and sliding member 4, this pin, spring plunger, or other device 17 would be removed, and the arm 3 and sliding member 4 would be adjusted to align with a different hole 7, corresponding to a new set angle Θ. In addition other embodiments can be created to obtain the effect of adjusting the angle of the sliding member 4 to various degrees. The sliding member 4 can be designed in order to remain directly adjacent to the side of the snowboard 1, or it can be designed to be located at an extended distance from the snowboard 1 in order to create a larger moment arm to thereby increase the stabilizing force provided to the rider. Also, the sliding member 4 itself can be designed to take on several different geometries and materials, however the main goal would be to create a sliding member 4 which provides support, but which is smooth and curved in a manner that it will not catch on the snow 10, or impede the movement of the snowboard 1, to any major extent.

In addition, there are several alternate configurations for the design, several of which will be mentioned here. First, the support apparatus 2 can be attached to the snowboard 1 in several manners other than being fastened to the snowboard 1 with the corresponding binding insert disc holes, such as being mounted to the snowboard 1 with hardware, being mounted to the bindings 5, being integrated into the bindings 5, being mounted to the snowboard 1 with suction, being clamped to the snowboard 1, and various other methods. The object of this invention is to attach to the snowboard 1 or the bindings 5 (e.g., the front binding or back binding), in a manner that allows the support apparatus 2 to provide support to the rider. In addition, the support apparatus itself can either be designed in a manner which allows all board and bindings to fit on the support apparatus 2, or the invention can be designed to be able to adjust to fit all bindings and boards universally, or it can be designed for one specific size snowboard or binding. Another aspect of the design that can be altered is the adjustment between the various skill levels. The main object of the invention is to allow the rider 9 to adjust the angle Θ of the arm 3 and sliding member 4 relative to the top surface 16 of the snowboard 1. In addition, springs or dampeners can be used to aid in dampening the impact of the rider 9 leaning against the sliding member 4 suddenly and to provide a variable level of support, which increases its supportive force as the rider 9 leans. In addition, there are various methods besides those mentioned here for adjusting the heights of the supports and locking them into position. The materials and manufacturing methods for this support apparatus 2 device can be adjusted in order to provide the ideal level of stiffness, strength, and mass. The support apparatus 2 can also be designed to set the arm 3 and sliding member 4 at a fixed angle Θ relative to the top surface 16 of the snowboard 1, which cannot be adjusted.

Finally the design can be adjusted to either constitute two separate support apparatuses attached to the snowboard 1 or (front or back) binding 5, which each have one sliding member 4 extending from each side of the snowboard 1, or one larger support apparatus, which can be attached to either the snowboard 1, or (front or back) binding 5, which features one sliding member 4 extending off of each side of the snowboard 1, in between the (front and back) bindings 5. The idea for this sort of support apparatus may apply to areas outside of snowboarding and can be used in a similar manner for learning other board sports or other applications. As previously stated, it is to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive.

The invention claimed is:

1. A training support apparatus for a snowboard with a front binding coupled to the snowboard and a back binding coupled to the snowboard, the training support apparatus comprising:

a base platform removably coupled to the snowboard, the base platform is disposed between the snowboard and one of the front and back bindings;

an arm member comprising a base end rotatably coupled to the base platform and an outrigger end disposed beyond a side of the snowboard; and a sliding member disposed at the outrigger end of the arm member, wherein the arm member is rotatable between a first angular position and a second angular position, wherein when the arm member is set at the first angular position, the outrigger end of the arm member is separated from a plane defined by the top surface of the snowboard by a first height, and wherein when the arm member is set at the second angular position, the outrigger end of the arm member is separated from the plane defined by the top surface of the snowboard by a second height greater than the first height, wherein the sliding member comprises a smooth curved outer surface extending entirely around the sliding member.

2. The training support apparatus of claim 1, wherein the arm member is locked to the base platform when set at the first angular position or when set at the second angular position.

3. The training support apparatus of claim 2, wherein the base platform comprises a plurality of openings disposed proximate to an end of the base platform; and the training support apparatus further comprises:

a pin inserted through the arm member at a point between the base end and the outrigger end of the arm member and inserted into one of the plurality of openings to lock the arm member to the base platform.

4. A training support apparatus for a snowboard with a front binding coupled to the snowboard and a back binding coupled to the snowboard, the training support apparatus comprising:

a base platform removably coupled to the snowboard, the base platform is disposed between the snowboard and one of the front and back bindings;

a first arm member comprising a base end rotatably coupled to the base platform and an outrigger end disposed beyond a first side of the snowboard;

a second arm member comprising a base end rotatably coupled to the base platform and an outrigger end disposed beyond a second side of the snowboard; and a first sliding member disposed at the outrigger end of the first arm member and a second sliding member disposed at the outrigger end of the second arm member, wherein the first arm member and the second arm member are each rotatable between a first angular position and a second angular position, wherein when the first arm member and the second arm member are each set at the first angular position, the outrigger end of the first arm member and the outrigger end of the second arm member are separated from a plane defined by the top surface of the snowboard by a first height, and wherein when the first arm member and the second arm member are each set at the second angular position, the outrigger end of the first arm member and the outrigger end of the second arm member are separated from the plane defined by the top surface of the snowboard by a second height greater than the first height, wherein the first sliding member comprises a smooth curved outer surface extending entirely around the first sliding member, and the second sliding member comprises a smooth curved outer surface extending entirely around the second sliding member.

* * * * *